US007145432B2

(12) United States Patent
Lussey et al.

(10) Patent No.: US 7,145,432 B2
(45) Date of Patent: Dec. 5, 2006

(54) FLEXIBLE SWITCHING DEVICES

(75) Inventors: David Lussey, Darlington (GB); Dianne Jones, Ilkley (GB); Steven Leftly, Ilkley (GB)

(73) Assignees: Canesis Network Ltd., Lincoln (NZ); Peratech Limited, Durham (GB)

( * ) Notice: Subject to any disclaimer, the term of this patent is extended or adjusted under 35 U.S.C. 154(b) by 0 days.

(21) Appl. No.: 10/276,220

(22) PCT Filed: May 17, 2001

(86) PCT No.: PCT/GB01/02183

§ 371 (c)(1),
(2), (4) Date: Nov. 14, 2002

(87) PCT Pub. No.: WO01/88935

PCT Pub. Date: Nov. 22, 2001

(65) Prior Publication Data

US 2004/0252007 A1 Dec. 16, 2004

(30) Foreign Application Priority Data

May 18, 2000 (GB) ..... 0011829.9

(51) Int. Cl.
*H01C 10/10* (2006.01)

(52) U.S. Cl. ..... 338/47; 338/99; 219/545

(58) Field of Classification Search ..... 338/47, 338/99, 101, 114; 219/529, 545; 358/22 R; 345/178; 235/462.44
See application file for complete search history.

(56) References Cited

U.S. PATENT DOCUMENTS 3,794,790 A 2/1974 Leyland
3,799,071 A * 3/1974 Gerlach ..... 108/46
3,806,471 A * 4/1974 Mitchell ..... 252/519.31
4,258,100 A * 3/1981 Fujitani et al. ..... 428/316.6
4,517,546 A * 5/1985 Kakuhashi et al. ..... 338/320
4,556,860 A * 12/1985 Tobias et al. ..... 338/22 SD
4,659,873 A * 4/1987 Gibson et al. ..... 178/18.05
4,745,301 A * 5/1988 Michalchik ..... 307/119
4,790,968 A * 12/1988 Ohkawa et al. ..... 264/104
4,794,365 A * 12/1988 Dunbar ..... 338/99
4,795,998 A * 1/1989 Dunbar et al. ..... 338/5
4,837,548 A * 6/1989 Lodini ..... 338/47
4,983,814 A * 1/1991 Ohgushi et al. ..... 338/22 R
4,994,783 A * 2/1991 Yaniger ..... 338/308
5,060,527 A * 10/1991 Burgess ..... 73/862.68
5,799,533 A * 9/1998 Seki et al. ..... 73/172
6,072,130 A * 6/2000 Burgess ..... 200/86 R
6,210,771 B1 * 4/2001 Post et al. ..... 428/100
6,229,123 B1 * 5/2001 Kochman et al. ..... 219/549
6,333,736 B1 * 12/2001 Sandbach ..... 345/178
6,452,479 B1 * 9/2002 Sandbach ..... 338/208
6,646,540 B1 * 11/2003 Lussey ..... 338/47

FOREIGN PATENT DOCUMENTS

DE 38 05 887 9/1989
EP 0 177 267 4/1986
GB 2115556 * 9/1983

(Continued)

*Primary Examiner*—Tu Hoang
(74) *Attorney, Agent, or Firm*—Nixon & Vanderhye P.C.

(57) ABSTRACT

An electronic resistor user interface comprises flexible conductive materials and a flexible variably resistive element capable of exhibiting a change in electrical resistance on mechanical deformation and is characterised by textile-form electrodes (10,12) a textile form variably resistive element (14) and textile-form members (16) connective to external circuitry.

18 Claims, 2 Drawing Sheets

FOREIGN PATENT DOCUMENTS

| | | | |
|---|---|---|---|
| GB | 2 343 516 | | 5/2000 |
| RU | 2 025 811 | | 12/1994 |
| RU | 2 134 443 | | 8/1999 |
| WO | WO98/33193 | * | 7/1998 |
| WO | WO99/38173 | * | 7/1999 |

* cited by examiner

FLEXIBLE SWITCHING DEVICES

CROSS REFERENCE TO RELATED APPLICATIONS

This is a national phase of PCT/GB01/02183, filed May 17, 2001, which claims priority to Great Britain Application No. 0011829.9, filed May 18, 2000 each incorporated herein by reference in its entirety.

TECHNICAL FIELD

This invention relates to electrical switching devices and more particularly to the architecture and construction of flexible switching devices and the use thereof in switching and proportional control of electric/electronic currents.

The working components of these devices can appear as and perform similarly to conventional textile materials and thus have applications as user-interfaces (including pressure sensors) particularly in the field of textile/wearable electronics. The devices are applicable as alternatives to hard electronic user-interfaces. Generally the devices can be produced using commercial textile manufacturing processes but the invention is not limited to such processes.

In this specification:

'textile' includes any assemblage of fibres, including spun, monofil and multifilament, for example woven, non-woven, felted or tufted; and the fibres present may be natural, semi-synthetic, synthetic, blends thereof and metals and alloys;

'electronic' includes 'low' currents as in electronic circuits and 'high' currents as in circuits commonly referred as 'electric';

'user interface' includes any system in which a mechanical action is registered as a change in electrical resistance or conductance. The mechanical action may be for example conscious bodily action such as finger pressure or footfall, animal movement, pathological bodily movement, expansion or contraction due to bodily or inanimate temperature variation, displacement in civil engineering structures.

'mechanical deformation' includes pressure, stretching and bending and combinations of these.

SUMMARY OF THE INVENTION

The invention provides an electronic resistor user-interface comprising flexible conductive materials and a flexible variable resistive element capable of exhibiting a change in electrical resistance on mechanical deformation, characterised by textile-form electrodes, a textile-form variably resistive element and textile-form members connective to external circuitry.

It will be appreciated that the textile form of each component of the user-interface may be provided individually or by sharing with a neighbouring component.

The electrodes, providing a conductive pathway to and from either side of the variably resistive element, generally conductive fabrics (these may be knitted, woven or non-woven), yarns, fibres, coated fabrics or printed fabrics or printed fabrics, composed wholly or partly of conductive materials such as metals, metal oxides, or semi-conductive materials such as conductive polymers (polyaniline, polypyrrole and polythiophenes) or carbon. Materials used for coating or printing conductive layers onto fabrics may include inks or polymers containing metals, metal oxides or semi-conductive materials such as conductive polymers or carbon. Preferred electrodes comprise stainless steel fibres, monofil and multifilament or stable conducting polymers, to provide durability under textile cleaning conditions.

The electrodes can be supported by non-conducting textile, preferably of area extending outside that of the electrodes, to support also connective members to be described.

Methods to produce the required electrical contact of the electrode with the variably resistive element include one or more of the following:

a) conductive yarns may be woven, knitted, embroidered in selected areas of the support so as to produce conductive pathways or isolated conductive regions or circuits;

b) conductive fabrics may be sewn or bonded onto the support;

c) conductive coatings or printing inks may be laid down onto the support by techniques such as spraying, screen printing, digital printing, direct coating, transfer coating, sputter coating, vapour phase deposition, powder coating and surface polymerisation.

Printing is preferred, if appropriate using techniques such as resist, to produce contact patterns at many levels of complexity and for repetition manufacture.

The extension of the support outside the electrode region is sufficient to accommodate the connective members to be described. It may be relatively small, to give a unit complete in itself and applicable to a user-apparatus such as a garment.

Alternatively it may be part of a user-apparatus, the electrodes and variably resistive element being assembled in situ. It may carry terminals at which the connective members pass the electric current to other conductors.

The variably resistive element, providing a controllable conductive pathway between the two electrodes, may take a number of forms, for example a) a self-supporting layer;

b) a layer containing continuous or long-staple textile reinforcement;

c) a coating applied to the surface of textile eg. as fabrics, yarns or fibres. This coating preferably contains a particulate variably resistive material as described in PCT/GB99/00205, and may contain a polymer binder such as polyurethane, PVC, polyacrylonitrile, silicone, or other elastomer. Alternatively the variably resistive material may be for example a metal oxide, a conductive polymer (such as polyaniline, polypyrrole and polythiophenes) or carbon. This coating may be applied for example by commercial methods such as direct coating, transfer coating, printing, padding or spraying;

d) it may contain fibres that are inherently electrically conductive or are extruded to contain a variably resistive material as described in PCT/GB99/00205;

e) it may be incorporated into or coated onto one of the electrodes in order to simplify manufacturing processes or increase durability in certain cases.

The variable resistor generally comprises a polymer and a particulate electrically conductive material. That material may be present in one or more of the following states:

a) a constituent of the base structure of the element;

b) particles trapped in interstices and/or adhering to surfaces;

c) a surface phase formed by interaction of conductive particles (i or ii below) with the base structure of the element or a coating thereon.

Whichever state the conductive material of the variably resistive element is present in, it may be introduced:

i) 'naked', that is, without pre-coat but possibly carrying on its surface the residue of a surface phase in equilibrium with its storage atmosphere or formed during incorporation into the element. This is clearly practicable for states a) and c), but possibly leads to a less physically stable element in stage b);

ii) lightly coated, that is, carrying a thin coating of a passivating or water-displacing material or the residue of such coating formed during incorporation into the element. This is similar to i) but may afford better controllability in manufacture;

iii) polymer-coated but conductive when undeformed This is exemplified by granular nickel/polymer compositions of so high nickel content that the physical properties of the polymer are weakly if at all discernable. As an example, for nickel starting particles of bulk density 0.85 to 0.95 this corresponds to a nickel/silicone volume ratio (tapped bulk: voidless solid) typically over about 10. Material of form iii) can be applied in aqueous suspension. The polymer may or may not be an elastomer. Form iii) also affords better controllability in manufacture than i).

iv) Polymer-coated but conductive only when deformed. This is exemplified by nickel/polymer compositions of nickel content lower than for iii), low enough for physical properties of the polymer to be discernible, and high enough that during mixing the nickel particles and liquid form polymer become resolved into granules rather than forming a bulk phase. This is preferred for b) an may be unnecessary for a) and c). It is preferred for the present invention: more details are given in co-pending application PCT/GB99/00205. An alternative would be to use particles made by comminuting materials as in v) below. Unlike i) to iii), material iv) can afford a response to deformation within each individual granule as well as between granules, but ground material v) is less sensitive. In making the element, material iv) can be applied in aqueous suspension;

v) Embedded in bulk phase polymer. This relates to a) and c) only. There is response to deformation within the bulk phase as well as between textile fibres.

The general definition of the preferred variably resistive material exemplified by iv) and v) above is that it exhibits quantum tunnelling conductance ('QTC') when deformed. This is a property of polymer compositions in which a filler selected from powder-form metals or alloys, electrically conductive oxides of said elements and alloys, and mixtures thereof are in is admixture with a non-conductive elastomer, having been mixed in a controlled manner whereby the filler is dispersed within the elastomer and remains structurally intact and the voids present in the starting filler powder become infilled with elastomer and particles of filler become set in close proximity during curing of the elastomer.

The connective textile member providing a highly flexible and durable electrically conductive pathway to and from each electrode may for example comprise conductive tracks in the non-conducting textile support fabric, ribbon or tape. The conductive tracks may be formed using electrically conductive yarns which may be woven, knitted, sewn or embroidered onto or into the non-conducting textile support. As in the construction of the electrodes, stainless steel fibres, monofil and multifilament are convenient as conductive yarns. The conductive tracks may also be printed onto the non-conducting textile support. In certain cases the conductive tracks may need to be insulated to avoid short circuits and this can be achieved by for example coating with a flexible polymer, encapsulating in a non-conducting textile cover or isolating during the weaving process. Alternatively the yarns may be spun with a conductive core and non-conducting outer sheath. In another alternative at least one connective member comprises variably resistive material pre-stressed to conductance, as described in PCT/GB99/02402.

DESCRIPTION OF THE PREFERRED EMBODIMENTS

In conjunction with appropriate electronics the devices may be used for digital type switching, analogue switching, proportional control, pressure sensing, flex sensing in the following applications, for example:

interfaces to electronic apparatus such as:

computers, PDA, personal audio, GPS;

domestic appliances, TV/video, computer games, electronic musical instruments, toys lighting and heating, clocks and watches;

personal healthcare such as heart rate monitors, disability and mobility aids;

automotive user controls;

controls for wearable electronics;

educational aids;

medical applications such as pressure sensitive bandages, dressings, garments, bed pads, sports braces;

sport applications such as show sensors, sensors in contact sport (martial arts, boxing, fencing), body armour that can detect and measure hits, blows or strikes, movement detection and measurement in sports garments;

seat sensors in any seating application for example auditoria and waiting rooms;

garment and shoe fitting;

presence sensors, for example under-carpet, in-flooring and in wall coverings.

Figure 1:
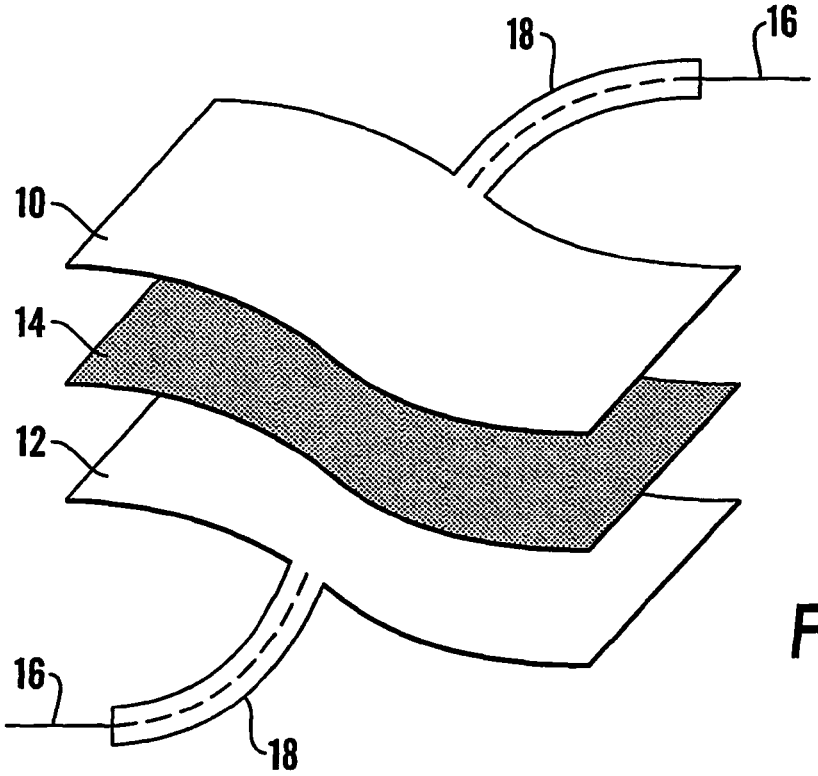
FIG. 1 shows a basic switch.

Referring to FIG. 1, the basic textile switch/sensor device comprises two self-supporting textile electrodes 10,12 sandwiching variably resistive element 14 made by applying to nylon cloth an aqueous suspension of highly void-bearing granular nickel-in-silicone at volume ratio within the composition of 7:1 capable of quantum tunneling conduction, as described in PCT/GB99/00205. Electrodes 10,12 and element 14 are fixed in intimate contact so as to appear and function as one textile layer. Each electrode 10,12 is conductively linked to a connective textile element 16 consisting of stainless steel thread in nylon tape 18 extending from electrodes 10,12. When pressure is applied to any area of electrode 10,12 the resistance between them decreases. The resistance between electrodes 10,12 will also decrease by bending.

Figure 2:
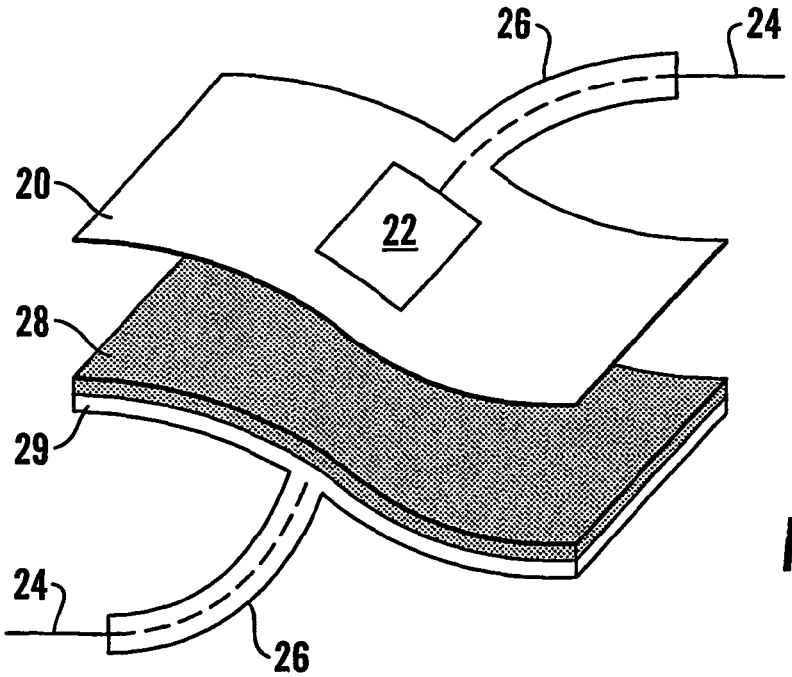
FIG. 2 shows a switch adaptable to multiple external circuits.

Referring to FIG. 2, in a variant of the basic textile switch/sensor, upper payer 20 is a non-conducting textile support under which adheres the upper electrode constituted by a discrete electrically conductive textile member to sub-area 22 and conductively linked to connective member 24, which is a conductive track in extension 26 of support 20. Variably resistive element 28, similar to that of element 12 above but containing polyurethane binder, is provided as a coating on lower electrode 29, the area of which is greater than that of upper electrode 22. Lower electrode 29 is formed with lower connective member 24, a conductive track on an extension 26 of electrode 29. When pressure is applied to sub-area 22, the resistance between elements 22 and 29 changes. Effectively this define a single switching or pressure sensitive area 22 in upper layer 20.

Figure 3:
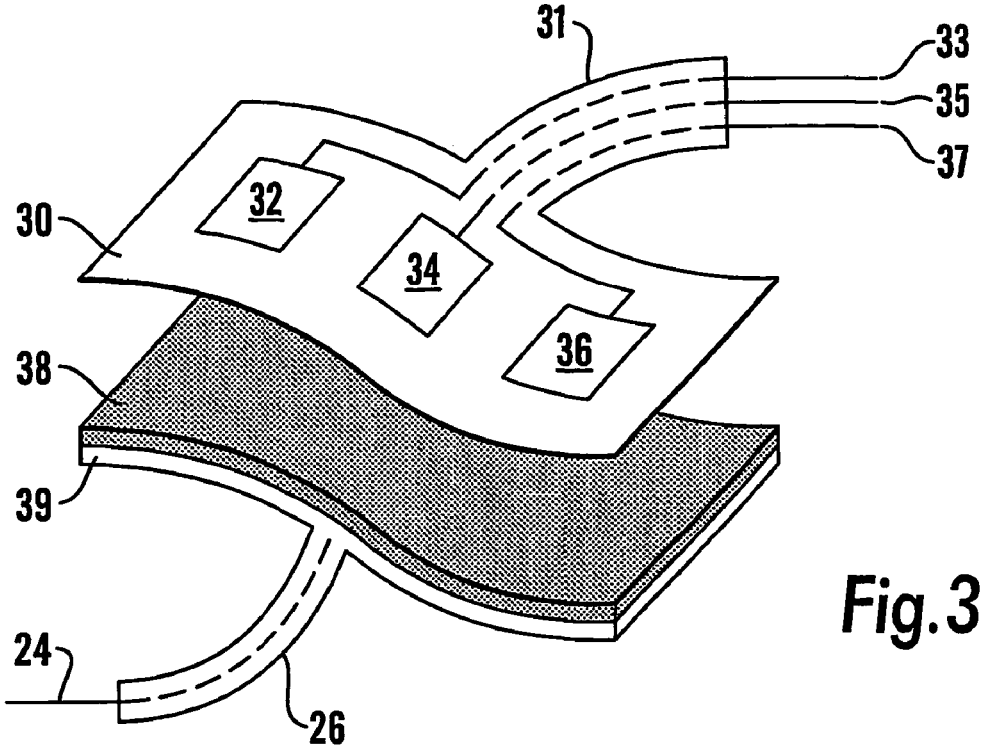
FIG. 3 shows a multiple key device.

Referring to FIG. 3, a multiple key textile switch/sensor device is similar in form to that shown in FIG. 2 except that under upper layer 30 are adhered three discrete electrodes constituted by electrically conductive sub-areas 32,34 and 36 isolated from each other by the non-conducting textile support and electrically linkable to external circuitry by way of connective members 33,35,37 respectively, which are conductive tracks on extension 31 of layer 30. Variably resistive element 38 is provided as a coating on lower electrode 39; it is of the type decreasing in resistance when mechanically deformed, since it depends on low or zero conductivity in the plane of element 38. Electrical connection to lower electrode 39 is by means of conductor 24 and extension 26, as in FIG. 2. When pressure is applied to any of areas overlying electrodes 32,34 and 36, the resistance between the relevant electrode(s) and lower electrode 39 decreases. Effectively this defines three separate switching or pressure sensitive areas 32,34 and 36, suitable as individual keys in a textile keypad or individual pressure sensors in a textile sensor pad. If the sensor is to respond to bending, other electrodes in contact with lower layer 39 would be provided to measure changes in conductivity in the plane of that layer; at the same time the external circuit would temporarily switch out the measurement perpendicular to the plane of layer 39.

Figure 4:
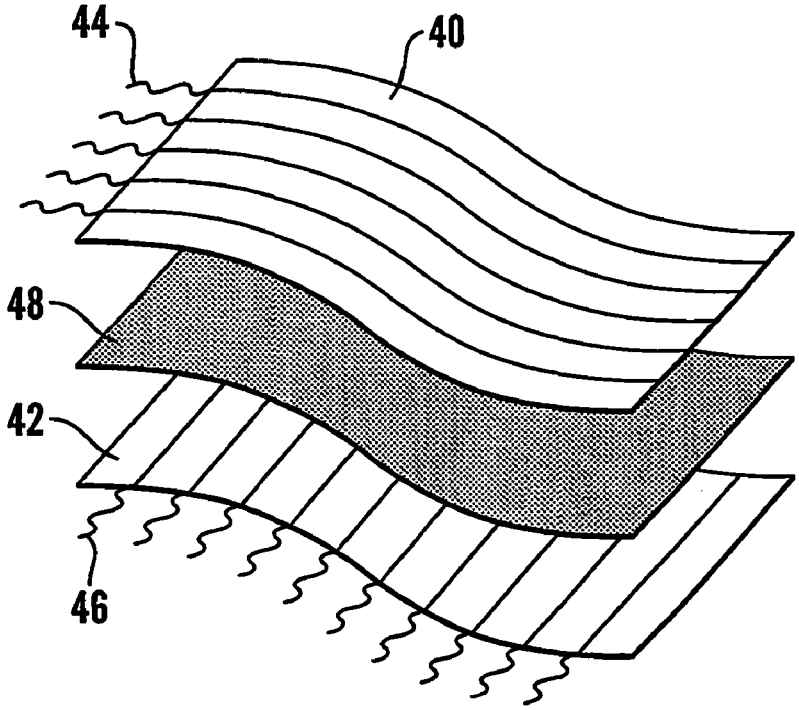
FIG. 4 shows a position-sensitive switch.

Referring to FIG. 4, in a matrix switch/sensor device the upper layer 40 and lower layer 42 each contains parallel linear electrodes consisting of isolated rows 44 and columns 46 of conductive areas woven into a non-conducting textile support. Conductive areas 44, 46 are warp yarns that have been woven between non-conductive yarns. Variably resistive element 48 is a sheet of fabric carrying nickel/silicone QTC granules as in FIG. 1 applied by padding with an aqueous dispersion of the granules, which are of the type decreasing in resistance on mechanical deformation. Layer 48 is supported between layers 40 and 42 and coincides in area with electrodes 44 and 46. When pressure is applied to a localised area of 40 or 42 there is a decrease in resistance at the junctions of the conductive rows 44 and columns 46 which fall within the localised area of applied pressure. This device can be used as a pressure map to locate force applied within the area of the textile electrodes. By defining areas of the textile electrodes as keys, this device can also be used as a multi-key keypad.

EXAMPLE

One electrode is a fabric consisting of a 20 g/m2 knitted mesh containing metallised nylon yarns. The variably resistive element was applied to this-fabric by transfer coating of:

75% w/w water based polyurethane (Impranil-Dow chemical); and

25% w/w nickel/silicone QTC granules (size 45–70 μm) and was cured on the fabric at 110° C. The other textile electrode element is another piece of the same knitted mesh. Each electrode was then sewn onto a non-conducting support fabric sheet of greater area than the electrode. The sensor was assembled with the coated side of the first electrode element facing the second electrode. Separate connective textile elements each consisting of metallised nylon thread were sewn up to each electrode so that good electrical contact was made with each. On the non-conducting support fabric outside the electrodes two metal textile press-studs were fixed such that each was in contact with the two conductive yarn tails. An electrical circuit was then connected to the press-studs so that a sensor circuit was completed.

What is claimed is:

1. A variable resistance user-interface comprising:

textile-form flexible conductive electrodes connective to associated circuitry; and a textile-form variably resistive element comprising a plurality of fibers and capable of exhibiting a change in electrical resistance on mechanical deformation, the textile-form variably resistive element being formed as a coating applied to said fibers continuously along the fibers' lengths, said textile-form variably resistive element being sandwiched between the electrodes.

2. A user-interface according to claim 1 in which at least one electrode is supported on non-conducting textile as conductive yarn woven, knitted or embroidered into the non-conducting textile.

3. A user-interface according to claim 1 in which at least one electrode is formed by applying a conductive printing ink to the support textile.

4. A user-interface according to claim 1 in which the variably resistive element consists of particulate variably resistive material and an elastomer binder.

5. A user-interface according to claim 4 in which the variably resistive material is a polymer composition in which a filler selected from powder-form metallic elements or alloys, electrically conductive oxides of said elements and alloys, and mixtures thereof are in admixture with a non-conductive elastomer, having been mixed in a controlled manner whereby the filler is dispersed within the elastomer and remains structurally intact and voids present in a starting filler powder become infilled with elastomer during curing of the elastomer.

6. A user-interface according to claim 1 in which the electrodes are connected to textile-form members, the textile-form members being connective to associated circuitry and wherein the textile-form members being constituted by conductive material present as conductive tracks in or on at least one of a textile support, a ribbon and a tape.

7. A user-interface as claimed in claim 6 in which the conductive tracks are at least one of woven, knitted, sewn, embroidered and printed.

8. A user-interface according to claim 1 in which at least one of the electrodes comprises variably resistive material pre-stressed to conductance.

9. A user-interface according to claim 1 in which at least one electrode is supported on non-conducting textile as conductive fabric sewn or bonded onto the non-conducting textile.

10. A user-interface according to claim 1 in which at least one electrode is supported on non-conducting textile as conductive coating applied to the non-conducting textile.

11. A user-interface according to claim 1 in which the textile form variably resistive element is fixed in intimate contact with each of the textile form electrodes.

12. A user-interface according to claim 1 in which the variably resistive element consists of particulate conducting polymer material and an elastomer binder.

13. A user-interface according to claim 12 in which the conducting polymer is one of the group consisting of polyaniline, polypyrrole and polythiophenes.

14. A user-interface according to claim 1 in which the variably resistive element consists of particulate carbon material and an elastomer binder.

15. A user interface according to claim 1 in which the electrodes are connected to textile-form members, the textile-form members being connective to associated circuitry and at least one of the textile-form members comprises variably resistive material pre-stressed to conductance.

16. A user-interface according to claim 1 further comprising at least one support textile having a sub-area; and at least one of said textile-form flexible conductive electrodes comprises a conductive textile-form member associated with the sub-area, said conductive textile-form member being connective to the associated circuitry.

17. A user-interface according to claim 16 wherein the conductive textile-form member comprises a terminal at which the conductive textile-form member passes electric current to the associated circuitry.

18. A variable resistance user-interface comprising:

textile-form flexible conductive electrodes connective to associated circuitry; and a textile-form variably resistive element comprising a plurality of fibers and capable of exhibiting a change in electrical resistance on mechanical deformation, the textile-form variable resistive element being formed as a variably resistive coating applied to said fibers continuously along the fibers' lengths, said textile form variably resistive element being sandwiched between the electrodes.

* * * * *